US007935304B2

(12) United States Patent
Lyon et al.

(10) Patent No.: US 7,935,304 B2
(45) Date of Patent: May 3, 2011

(54) CASTABLE MAGNESIUM ALLOYS

(75) Inventors: Paul Lyon, Bolton (GB); John King, Bury (GB); Hossein Karimzadeh, Cheshire (GB); Ismet Syed, Cheshire (GB)

(73) Assignee: Magnesium Electron Ltd., Manchester (GB)

( * ) Notice: Subject to any disclaimer, the term of this patent is extended or adjusted under 35 U.S.C. 154(b) by 342 days.

(21) Appl. No.: 10/545,621

(22) PCT Filed: Oct. 8, 2004

(86) PCT No.: PCT/GB2004/004285

§ 371 (c)(1),
(2), (4) Date: Aug. 16, 2005

(87) PCT Pub. No.: WO2005/035811

PCT Pub. Date: Apr. 21, 2005

(65) Prior Publication Data

US 2006/0228249 A1 Oct. 12, 2006

(30) Foreign Application Priority Data

Oct. 10, 2003 (GB) ..... 0323855.7

(51) Int. Cl.
*C22C 23/06* (2006.01)

(52) U.S. Cl. ..... 420/406; 148/420; 148/538

(58) Field of Classification Search ..... 420/402, 420/403, 404, 405, 406, 407, 408, 409, 410, 420/411, 412, 413, 414; 148/420, 400; *C22C 23/06*
See application file for complete search history.

(56) References Cited

U.S. PATENT DOCUMENTS

| | | | | |
|---|---|---|---|---|
| 3,092,492 | A | 6/1963 | Foerster | |
| 3,496,035 | A * | 2/1970 | Foerster | 148/420 |
| 5,077,138 | A * | 12/1991 | Hino et al. | 428/614 |
| 5,143,564 | A | 9/1992 | Gruzleski et al. | |
| 6,103,024 | A * | 8/2000 | Sapru et al. | 148/403 |
| 6,193,817 | B1 * | 2/2001 | King et al. | 148/420 |
| 6,299,834 | B1 * | 10/2001 | Horie et al. | 420/406 |

FOREIGN PATENT DOCUMENTS

| | | |
|---|---|---|
| EP | 0 400 574 | 12/1990 |
| EP | 1 329 530 | 7/2003 |
| GB | 664819 | 1/1952 |

(Continued)

OTHER PUBLICATIONS

Apps, P.J., Karimzadeh, H., King, J.F., Lorimer, G.W., "Phase compositions in magnesium-rare earth alloys containing yttrium, gadolinium or dysprosium," Scripta Materialia 48 (2003) pp. 475-481.*

(Continued)

*Primary Examiner* — Scott Kastler
*Assistant Examiner* — Vanessa Velasquez
(74) *Attorney, Agent, or Firm* — Pearne & Gordon LLP

(57) ABSTRACT

This invention relates to magnesium-based alloys particularly suitable for casting applications where good mechanical properties at room and at elevated temperatures are required. The alloys contain: 2 to 4.5% by weight of neodymium; 0.2 to 7.0% of at least one rare earth metal of atomic No. 62 to 71; up to 1.3% by weight of zinc; and 0.2 to 0.7% by weight of zirconium; optionally with one or more other minor component. They are resistant to corrosion, show good age-hardening behaviour, and are also suitable for extrusion and wrought alloy applications.

21 Claims, 9 Drawing Sheets

◄ Increasing Nd & Gd Content

FOREIGN PATENT DOCUMENTS

Figure 1:
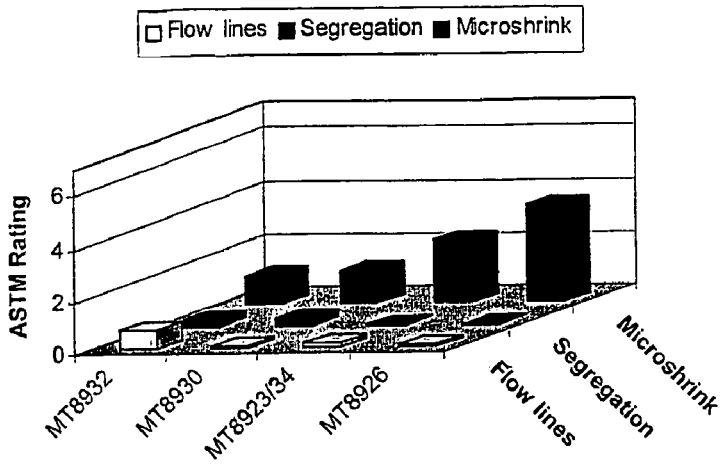

| | | | |
|---|---|---|---|
| GB | 2 095 288 | | 9/1982 |
| SU | 585 940 | | 2/1978 |
| SU | 1 360 223 | | 9/1985 |
| SU | 1360223 | A1 * | 10/1994 |
| WO | 96/24701 | | 8/1996 |

OTHER PUBLICATIONS

English human translation of SU 1 360 223 A1.*

Hawley's Condensed Chemical Dictionary. Definition of "rare earth." Copyright 2002.*

Lyon, Paul, "New Magnesium Alloy for Aerospace and Specialty Applications," Magnesium Technology 2004, ed. Alan A. Luo, a publication of TMS (The Minerals, Metals & Materials Society), 2004.*

Elektron 21, Datasheet: 455, by Magnesium Elektron.*

Magnesium Casting Alloys, Datasheet: 440, by Magnesium Elektron.*

Buschow, K.H. Juergen et al., editors; H. Westengen, author of article; Encyclopedia of Materials: Science and Technology, vol. 5; "Magnesium Alloys: Properties and Applications"; pp. 4746-4754, 2001.*

Mukhina et al.: "Investigation of the microstructure and properties of castable neodymium- and yttrium-bearing magnesium alloys at elevated temperatures", Metal Science and Heat Treatment, Consultants Bureau, New York, US, vol. 39, No. 5/6, May 1997, pp. 202-206, XP000739773.

* cited by examiner

◄ Increasing Nd & Gd Content

CASTABLE MAGNESIUM ALLOYS

This application claims the benefit of International Application Number PCT/GB2004/004285, which was published in English on Apr. 21, 2005.

This invention relates to magnesium-based alloys particularly suitable for casting applications where good mechanical properties at room and at elevated temperatures are required.

Because of their strength and lightness magnesium-based alloys are frequently used in aerospace applications where components such as helicopter gearboxes and jet engine components are suitably formed by sand casting. Over the last twenty years development of such aerospace alloys has taken place in order to seek to obtain in such alloys the combination of good corrosion resistance without loss of strength at elevated temperatures, such as up to 200° C.

A particular area of investigation has been magnesium-based alloys which contain one or more rare earth (RE) elements. For example WO 96/24701 describes magnesium alloys particularly suitable for high pressure die casting which contain 2 to 5% by weight of a rare earth metal in combination with 0.1 to 2% by weight of zinc. In that specification "rare earth" is defined as any element or mixture of elements with atomic Nos. 57 to 71 (lanthanum to lutetium). Whilst lanthanum is strictly speaking not a rare earth element it is intended to be covered, but elements such as yttrium (atomic No 39) are considered to be outside the scope of the described alloys. In the described alloys optional components such as zirconium can be included, but there is no recognition in that specification of any significant variation in the performance in the alloys by the use of any particular combination of rare earth metals.

WO 96/24701 has been recognized as a selection invention over the disclosure of a speculative earlier patent, GB-A-664819, which teaches that the use of 0.5% to 6% by weight of rare earth metals of which at least 50% consists of samarium will improve the creep resistance of magnesium base alloys. There is no teaching about castability.

Similarly in U.S. Pat. No. 3,092,492 and EP-A-1329530 combinations of rare earth metals with zinc and zirconium in a magnesium alloy are described, but without recognition of the superiority of any particular selection of any combination of rare earth metals.

Among commercially successful magnesium-rare earth alloys there is the product known as "WE43" of Magnesium Elektron which contains 2.2% by weight of neodymium and 1% by weight of heavy rare earths is used in combination 0.6% by weight of zirconium and 4% by weight of yttrium. Although this commercial alloy is very suitable for aerospace applications, the castability of this alloy is affected by its tendency to oxidize in the molten state and to show poor thermal conductivity characteristics. As a result of these deficiencies special metal handling techniques may have to be used which can not only increase the production costs but also restrict the possible applications of this alloy.

There is therefore a need to provide an alloy suitable for aerospace applications which possesses improved castability over WE43, whilst maintaining good mechanical properties.

SU-1360223 describes a broad range of magnesium-based alloys which contains neodymium, zinc, zirconium, manganese and yttrium, but requires at least 0.5% yttrium. The specific example uses 3% yttrium. The presence of significant levels of yttrium tends to lead to poor castability due to oxidation.

In accordance with the present invention there is provided a magnesium based alloy having improved castability comprising:

at least 85% by weight of magnesium;

2 to 4.5% by weight of neodymium;

0.2 to 7.0% of at least one rare earth metal of atomic No. 62 to 71;

up to 1.3% by weight of zinc; and 0.2 to 1.0% by weight of zirconium;

optionally with one or more of:

up to 0.4% by weight of other rare earths;

up to 1% by weight of calcium;

up to 0.1% by weight of an oxidation inhibiting element other than calcium;

up to 0.4% by weight of hafnium and/or titanium;

up to 0.5% by weight of manganese;

no more than 0.001% by weight of strontium;

no more than 0.05% by weight of silver;

no more than 0.1% by weight of aluminium;

no more than 0.01% by weight of iron; and less than 0.5% by weight of yttrium;

with any remainder being incidental impurities.

In the alloy of the present invention it has been found that the neodymium provides the alloy with good mechanical properties by its precipitation during the normal heat treatment of the alloy. Neodymium also improves the castability of the alloy, especially when present in the range of from 2.1 to 4% by weight. A particularly preferred alloy of the present invention contains 2.5 to 3.5% by weight, and more preferably about 2.8% by weight of neodymium.

The rare earth component of the alloys of the present invention is selected from the heavy rare earths (HRE) of atomic numbers 62 to 71 inclusive. In these alloys the HRE provides precipitation hardening, but this is achievable with a level of HRE which is much lower than expected. A particularly preferred HRE is gadolinium, which in the present alloys has been found to be essentially interchangeable with dysprosium, although for an equivalent effect slightly higher amounts of dysprosium are required as compared with gadolinium. A particularly preferred alloy of the present invention contains 1.0 to 2.7% by weight, more preferably 1.0 to 2.0% by weight, especially about 1.5% by weight of gadolinium. The combination of the HRE and neodymium reduces the solid solubility of the HRE in the magnesium matrix usefully to improve the alloy's age hardening response.

For significantly improved strengthening and hardness of the alloy the total RE content, including HRE, should be greater than about 3% by weight. By using an HRE there is also a surprising improvement in the alloy's castability, particularly its improved microshrinkage behaviour.

Although the heavy rare earths behave similarly in the present alloys, their different solubilities result in preferences. For example, samarium does not offer the same advantage as gadolinium in terms of castability combined with good fracture (tensile) strength. This appears to be so because if samarium were present in a significant amount excess second phase would be generated at grain boundaries, which may help castability in terms of feeding and reduced porosity, but would not dissolve into the grains during heat treatment (unlike the more soluble gadolinium) and would therefore leave a potentially brittle network at the grain boundaries, resulting in reduced fracture strength—see the results shown in Table 1.

TABLE 1

| | Melt Identity | Sm | Zn | Nd | Gd | Zr | Y.S (Mpa) | UTS (Mpa) | Elongation % |
|---|---|---|---|---|---|---|---|---|---|
| | | (Wt %) | | | | | | | |
| Sm containing Alloys | DF 8540/49 (average of 2 melts) | 1.15 | 0.73 | 2.5 | 0 | 0.5 | 164 | 218 | 1.5 |
| Gd containing Alloys | DF 8548 | 0 | 0.77 | 2.5 | 1.5 | 0.5 | 167 | 295 | 7 |

The presence of zinc in the present alloys contributes to their good age hardening behaviour, and a particularly preferred amount of zinc is 0.2 to 0.6% by weight, more preferably about 0.4% by weight. Furthermore by controlling the amount of zinc to be from 0.2 to 0.55% by weight with the gadolinium content up to 1.75% by weight good corrosion performance is also achievable.

Not only does the presence of zinc alter the age hardening response of a magnesium-neodymium alloy, but also zinc changes the alloy's corrosion behaviour when in the presence of an HRE. The complete absence of zinc can lead to significantly increased corrosion. The minimum amount of zinc needed will depend upon the particular composition of the alloy, but even at a level only just above that of an incidental impurity zinc will have some effect. Usually at least 0.05% by weight and more often at least 0.1% by weight of zinc is needed to obtain both corrosion and age-hardening benefits. Up to 1.3% by weight the onset of over-ageing is usefully delayed, but above this level zinc reduces the peak hardness and tensile properties of the alloy.

In the present alloys zirconium functions as a potent grain refiner, and a particularly preferred amount of zirconium is 0.2 to 0.7% by weight, particularly 0.4 to 0.6% by weight, and more preferably about 0.55% by weight.

The function and the preferred amounts of the other components of the alloys of the present invention are as described in WO 96/24701. Preferably the remainder of the alloy is not greater than 0.3% by weight, more preferably not greater than 0.15% by weight.

As regards the age hardening performance of the alloys of the present invention, up to 4.5% by weight of neodymium can be used, but it has been found that there is a reduction in tensile strength of the alloy if more than 3.5% by weight is used. Where high tensile strength is required, the present alloys contain 2 to 3.5% by weight of neodymium.

Whilst the use in magnesium alloys of a small amount of the mixture of neodymium and praseodymium known as "didymium" in combination with zinc and zirconium is known, for example 1.4% by weight in U.S. Pat. No. 3,092,492, there is no recognition in the art that the use of 2 to 4.5% by weight of neodymium in combination with from 0.2 to 7.0%. preferably from 1.0 to 2.7%, by weight of HRE gives rise to alloys which not only have good mechanical strength and corrosion characteristics but which also possess good castability qualities. In particular, it has been found that by using a combination of neodymium with at least one HRE the total rare earth content of the magnesium alloy can be increased without detriment to the mechanical properties of the resulting alloy. In addition, the alloy's hardness has been found to improve by additions of HRE of at least 1% by weight, and a particularly preferred amount of HRE is about 1.5% by weight. Gadolinium is the preferred HRE, either as the sole or major HRE component, and it has been found that its presence in an amount of at least 1.0% by weight allows the total RE content to be increased without detriment to the alloy's tensile strength. Whilst increasing the neodymium content improves strength and castability, beyond about 3.5% by weight fracture strength is reduced especially after heat treatment. The presence of the HRE, however, allows this trend to continue without detriment to the tensile strength of the alloy. Other rare earths such as cerium, lanthanum and praseodymium can also be present up to a total of 0.4% by weight.

Whilst in the known commercial alloy WE43 the presence of a substantial percentage of yttrium is considered necessary, it has been found that in the alloys of the present invention yttrium need not be present, and therefore at the present time the alloys of the present invention can be produced at lower cost than WE43. It has, however, been found that a small amount, usually less than 0.5% by weight, of yttrium can be added to the alloys of the present invention without substantial detriment to their performance.

As with the alloys of WO 96/24701, the good corrosion resistance of the alloys of the present invention is due to the avoidance both of detrimental trace elements, such as iron and nickel, and also of the corrosion promoting major elements which are used in other known alloys, such as silver. Testing on a sand cast surface according to the industry standard ASTM B117 salt fog test yielded a corrosion performance of <100 Mpy (Mils penetration per year) for samples of the preferred alloys of the present invention, which is comparable with test results of <75 Mpy for WE43.

For the preferred alloys of the present invention with approximately 2.8% neodymium, the maximum impurity levels in weight percent are:

| | |
|---|---|
| Iron | 0.005, |
| Nickel | 0.0018, |
| Copper | 0.015, |
| Manganese | 0.03, |
| and Silver | 0.05. |

The total level of the incidental impurities should be no more than 0.3% by weight. The minimum magnesium content in the absence of the recited optional components is thus 86.2% by weight.

The present alloys are suitable for sand casting, investment casting and for permanent mould casting, and also show good potential as alloys for high pressure die casting. The present alloys also show good performance as extruded and wrought alloys.

The alloys of the present invention are generally heat treated after casting in order to improve their mechanical properties. The heat treatment conditions can however also influence the corrosion performance of the alloys. Corrosion can be dependent upon whether microscopic segregation of any cathodic phases can be dissolved and dispersed during the heat treatment process. Heat treatment regimes suitable for the alloys of the present invention include:

| | | |
|---|---|---|
| Solution Treat[1] | Hot Water Quench | |
| Solution Treat | Hot Water Quench | Age[2] |
| Solution Treat | Cool in still air | Age |
| Solution Treat | Fan air cool | Age |

[1]8 Hours at 520° C.
[2]16 Hours at 200° C.

It has been found that overall a slow cool after solution treatment generated poorer corrosion resistance, than the faster water quench.

Examination of the microstructure revealed that coring within the grains of slow cooled material was less evident than in quenched material and that precipitation was coarser. This coarser precipitate was attacked preferentially leading to a reduction in corrosion performance.

The use of a hot water, or polymer modified quenchant, after solution treatment is therefore the preferred heat treatment route and contributes to the excellent corrosion performance of the alloys of the present invention.

When compared with the known commercial magnesium zirconium alloy RZ5 (equivalent to ZE41) which contains 4% by weight zinc, 1% by weight RE and 0.6% by weight zirconium, it was found that the preferred alloys of the present invention showed a much lower tendency to suffer from oxide-related defects. Such reduced oxidation is normally associated in magnesium alloys with the presence of beryllium or calcium. However, in the tested alloys of the present invention neither beryllium nor calcium were present. This suggests that the HRE component—here specifically gadolinium—was itself providing the oxidation-reducing effect.

Figure 2:
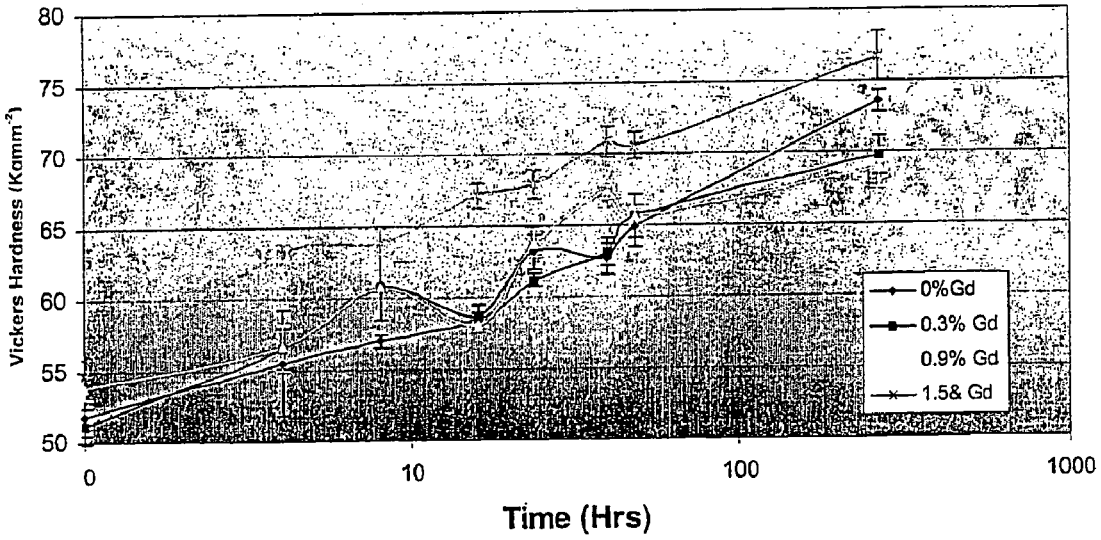
Figure 3:
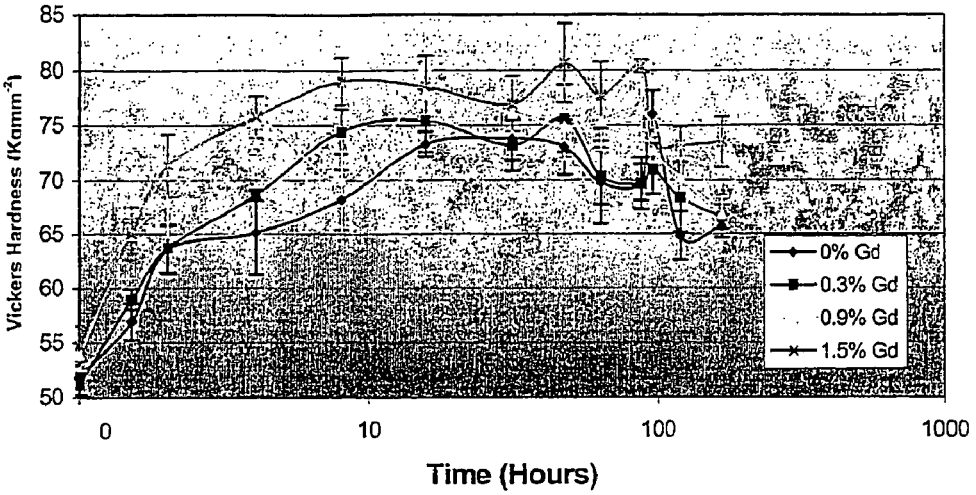
Figure 4:
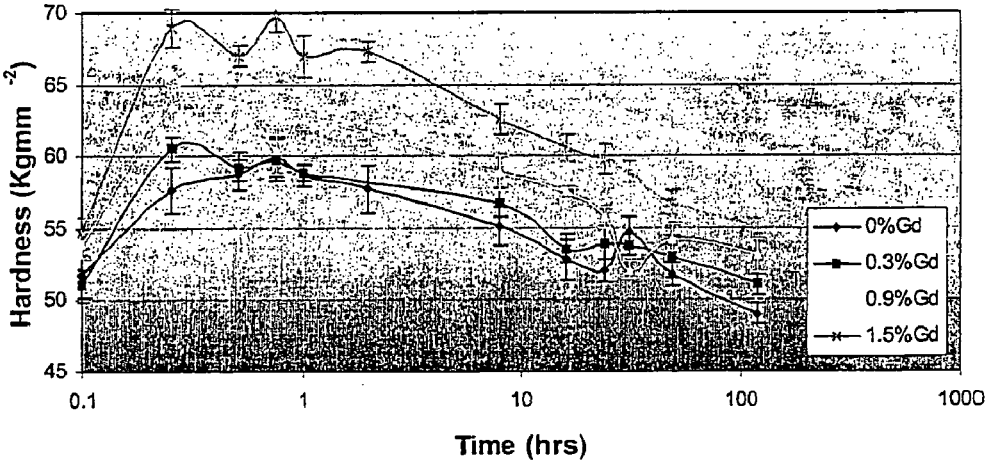
Figure 5:
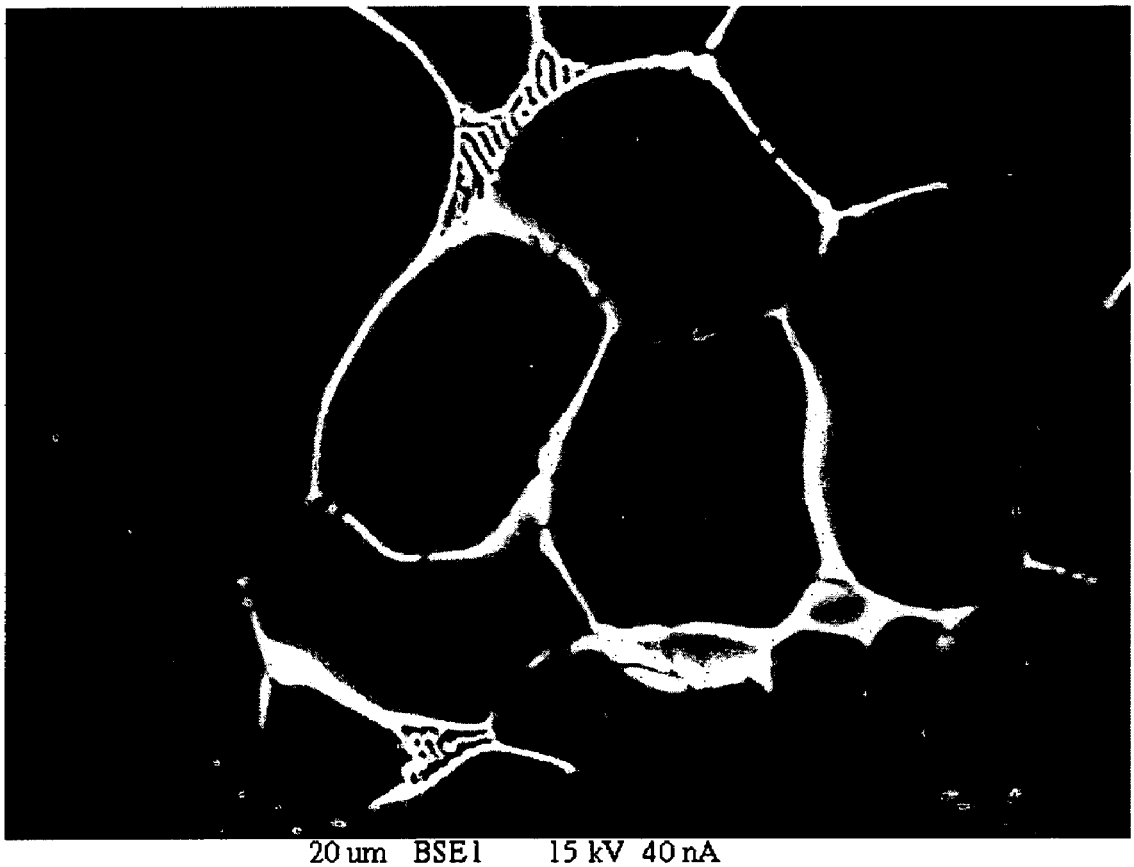
Figure 6:
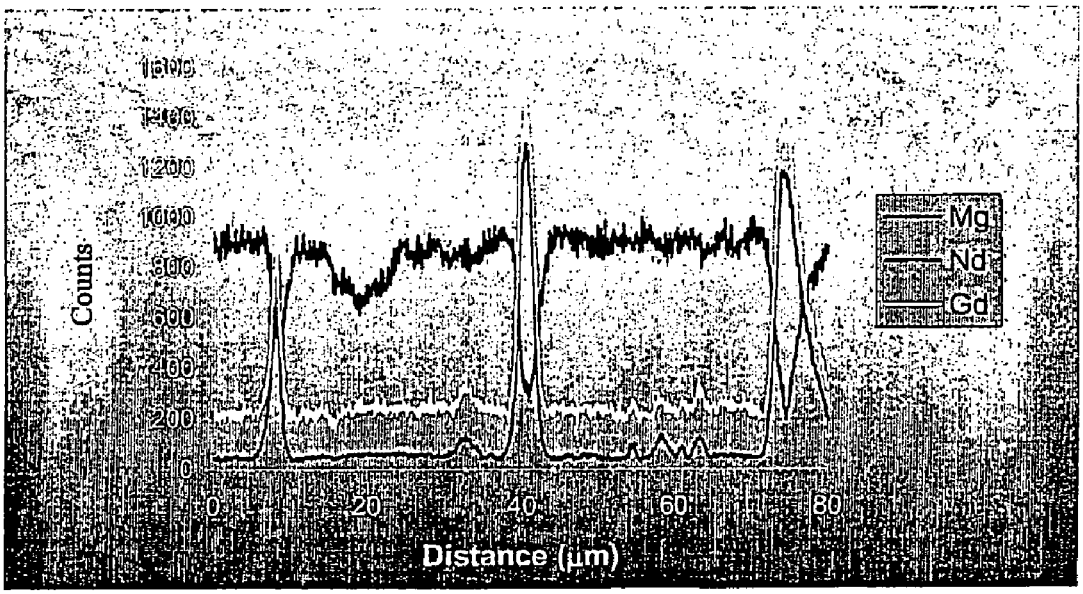
Figure 7:
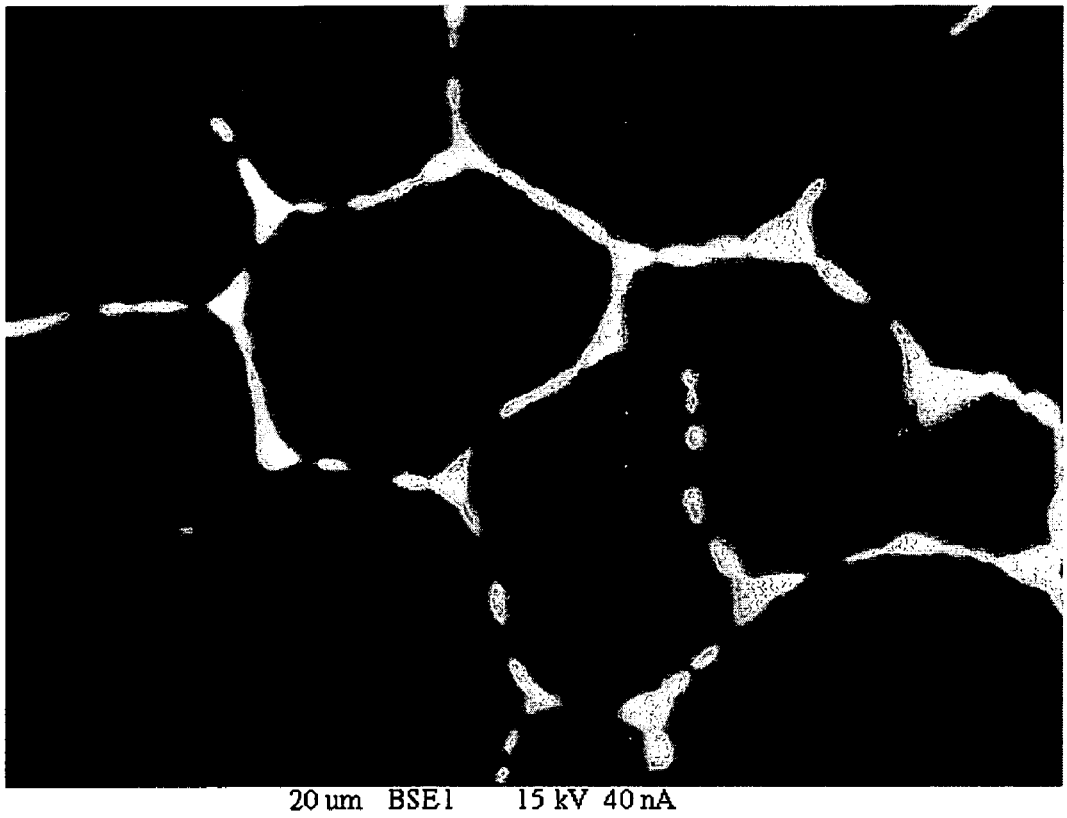
Figure 8:
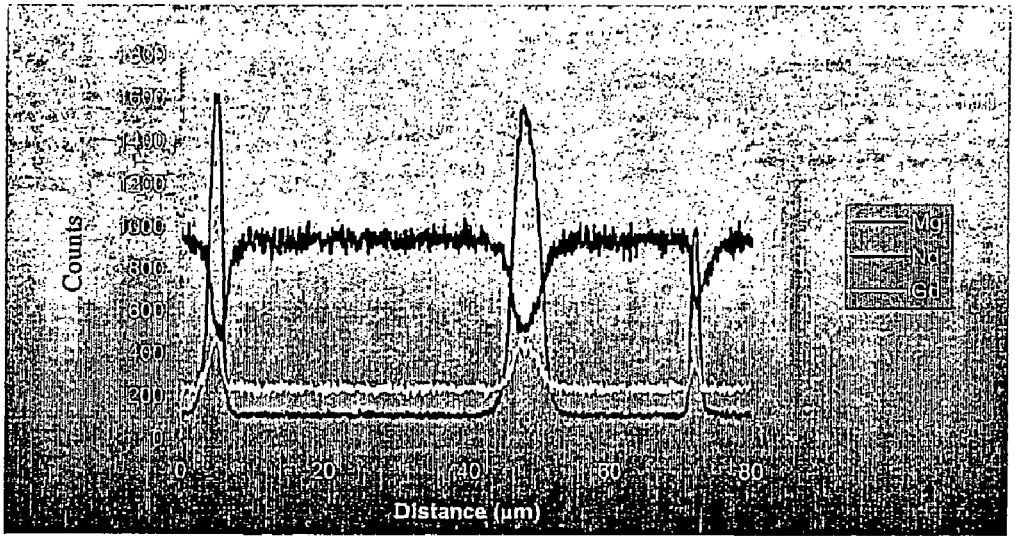
Figure 9:
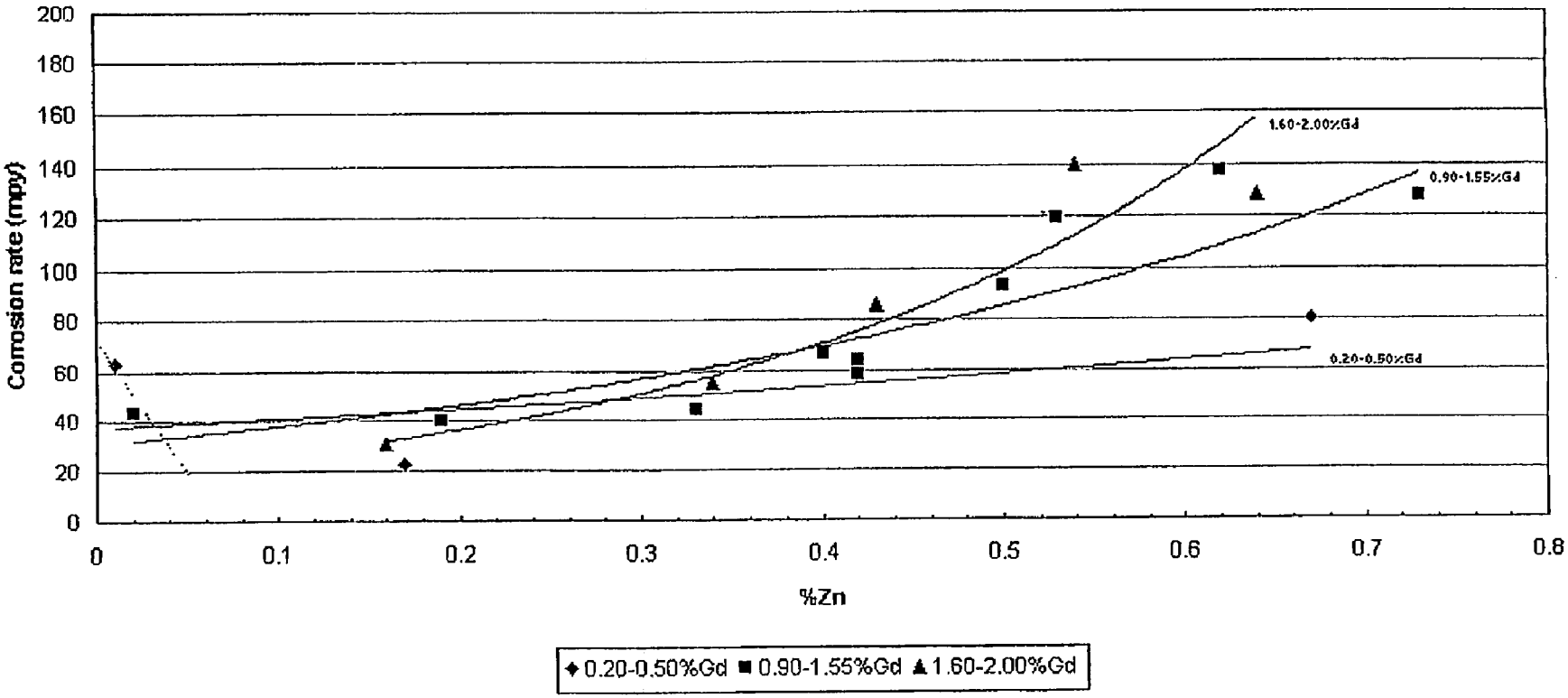
Figure 10:
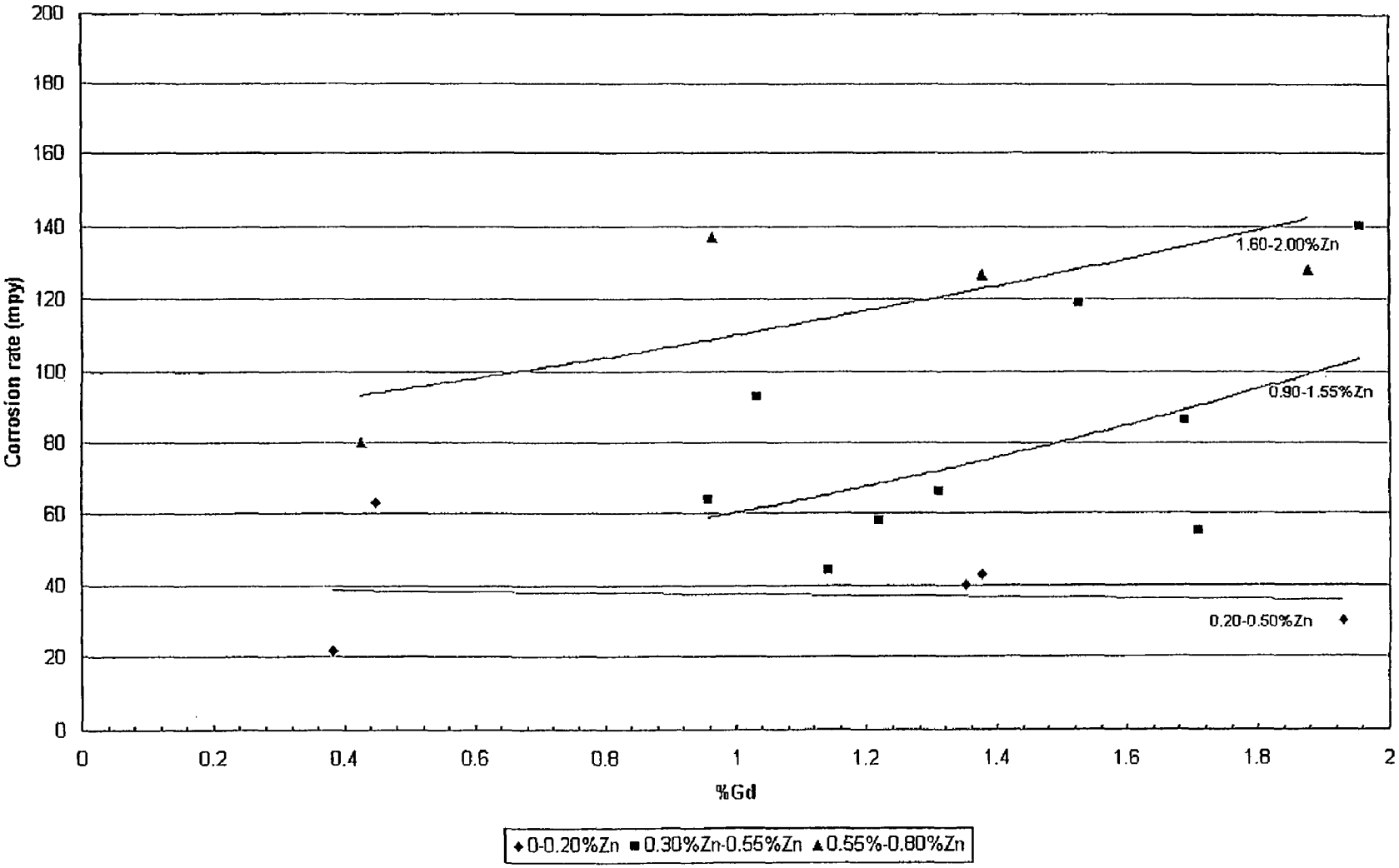
Figure 11:
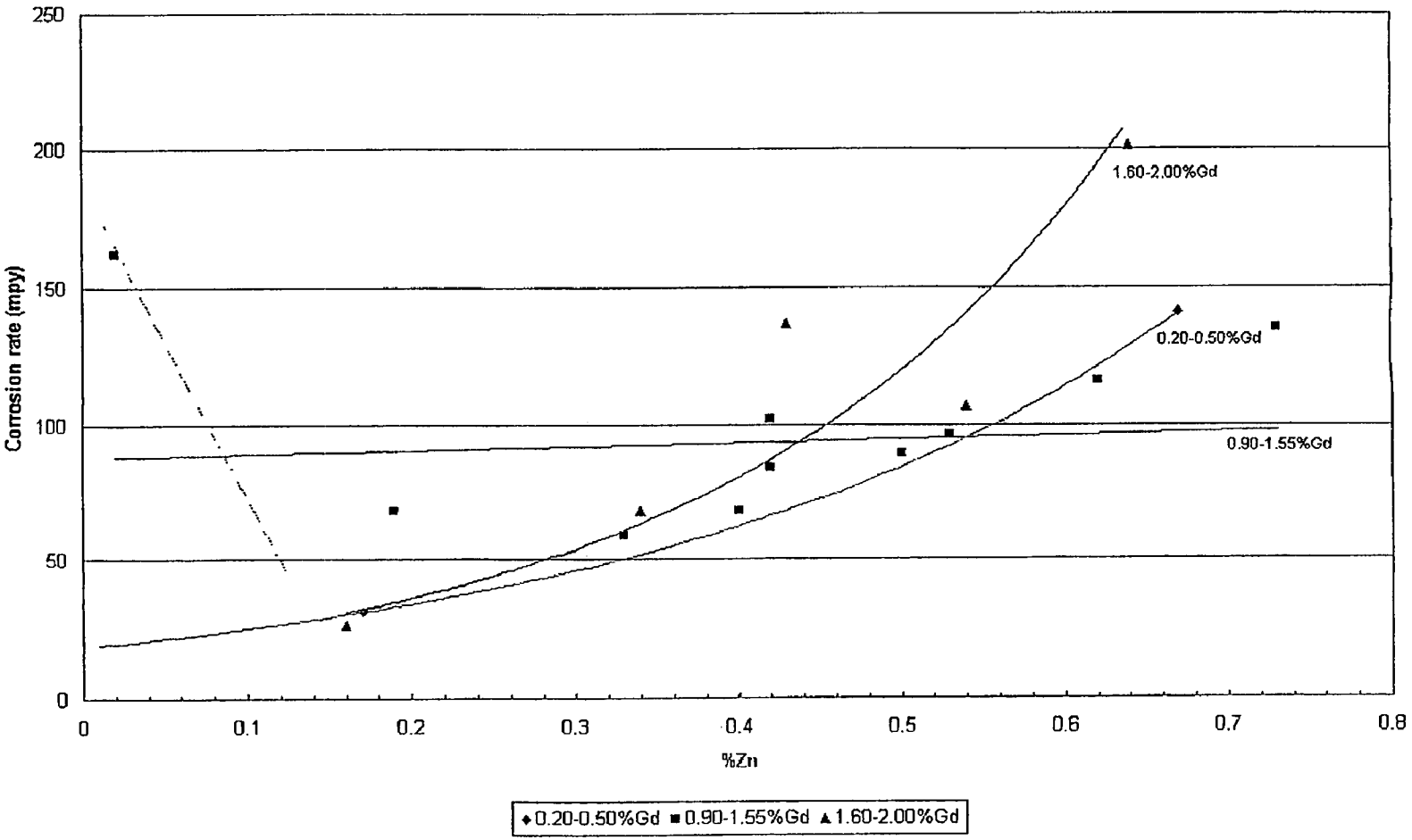

The following Examples are illustrative of preferred embodiments of the present invention. In the accompanying drawings:

FIG. 1 is a diagrammatic representation of the effect of the melt chemistry of alloys of the present invention on radiographic defects detected in the produced castings, FIG. 2 is a graph showing ageing curves for alloys of the present invention at 150° C., FIG. 3 is a graph showing ageing curves for alloys of the present invention at 200° C., FIG. 4 is a graph showing ageing curves for alloys of the present invention at 300° C., FIG. 5 is a micrograph showing an area of a cast alloy containing 1.5% gadolinium scanned by EPMA in its as-cast condition, FIG. 6 is a graph showing the qualitative distribution of magnesium, neodymium and gadolinium along the line scan shown in FIG. 5, FIG. 7 is a micrograph showing an area of a cast alloy containing 1.5% gadolinium scanned by EPMA in its T6 condition, FIG. 8 is a graph showing the qualitative distribution of magnesium, neodymium and gadolinium along the line scan shown in FIG. 7, FIG. 9 is a graph showing the variation of corrosion with increasing zinc content of alloys of the invention in their T6 temper after hot water quenching, FIG. 10 is a graph showing the variation of corrosion with increasing gadolinium content of alloys of the invention in their T6 temper after hot water quenching, and FIG. 11 is a graph showing the variation of corrosion with increasing zinc content of alloys of the invention in their T6 temper after air cooling.

1. EXAMPLES

Corrosion Testing 1

An initial set of experiments was carried out to determine the general effect of the following upon the corrosion performance of the alloys of the present invention:

Alloy chemistry
Melting variables
Surface Preparation Treatments

Melts were carried out with different compositions and different casting techniques. Samples from these melts were then corrosion tested in accordance with ASTM B117 salt fog test. Weight losses were then determined and corrosion rates calculated.

All melts were within the composition range of Table 2 below unless otherwise stated, the remainder being magnesium with only incidental impurities.

TABLE 2

| | Element | | | | |
|---|---|---|---|---|---|
| | Nd | Zn | Gd | Fe | Zr |
| Composition | 2.65-2.85 | 0.7-0.8 | 0.25-0.35 | <0.003 | 0.45-0.55 |

All corrosion coupons (sand-cast panels) were shot blasted using alumina grit and then acid pickled. The acid pickle used was an aqueous solution containing 15% $HNO_3$ with immersion on this solution for 90 seconds and then 15 seconds in a fresh solution of the same composition. All corrosion cylinders were machined and subsequently abraded with glass paper and pumice. Both types of test piece were degreased before corrosion testing.

The samples were placed in the salt fog test ASM B117 for seven days. Upon completion of the test, corrosion product was removed by immersing the sample in hot chromic acid solution.

Summary of Initial Results and Preliminary Conclusions

1. Chemical Composition a) Effect of Neodymium—See Table 3

TABLE 3

| Composition | Melt | Coupons | |
|---|---|---|---|
| Change | ID | mcd | mpy |
| 2% Nd | DF8544 | 0.9 | 70 |
| 4% Nd | DF8545 | 0.98 | 76.25 |

"mcd" stands for $mg/cm^2/day$

The effect of neodymium is negligible, and showed no significant effect on the rate of corrosion.

b) Effect of Zinc—See Table 4

TABLE 4

| Composition | Melt | Coupons | |
|---|---|---|---|
| Change | ID | mcd | mpy |
| 0.5% Zn | DF8488 | 0.5 | 42 |
| 1% Zn | DF8490 | 0.7 | 56 |
| 1.5% Zn | DF8495 | 1.6 | 126 |

An increase in zinc of up to 1% has little effect but higher levels up to 1.5% increases corrosion.

c) Effect of Gadolinium—See Table 5

TABLE 5

| Composition | | Coupons | | Cylinders | |
|---|---|---|---|---|---|
| Change | Melt ID | mcd | mpy | mcd | mpy |
| 0% Gd | DF8510 | 1.1 | 86 | 0.5 | 39 |
| 0.3% Gd | DF8536 DF8542 | 1.0 | 82 | 0.17 | 14 |
| 1% Gd[1] | DF8397 | — | — | 0.29 | 23 |
| 1.5% Gd[2] | DF8539 DF8548 | 1.2 | 89 | 0.17 | 14 |
| 2% Gd | DF8535 DF8547 | 1.6 | 127 | 0.31 | 25 |

[1]The neodymium content was raised to 3% from 2.7%

[2]The neodymium was reduced from 2.7% to 2.5% in both melts.

The addition of gadolinium has no significant effect on the corrosion of the alloy up to 1.5%. The much reduced corrosion of the cylinders was noted.

d) Effect of Samarium—See Table 6

TABLE 6

| Composition | | | Coupons | | Cylinders | |
|---|---|---|---|---|---|---|
| Change | | Melt ID | mcd | mpy | mcd | mpy |
| 0% Gd | 0% Sm | DF8510 | 1.1 | 86 | 0.5 | 39 |
| 1.5% Gd | 0% Sm[2] | DF8539 DF8548 | 1.2 | 89 | 0.17 | 14 |
| 0% Gd | 1.5% Sm[2] | DF8540 DF8549 | 1.2 | 91 | 0.3 | 24 |

The addition of Samarium to the alloy with no Gadolinium gives no change in the corrosion resistance of the alloy.

The replacement of Gadolinium with Samarium gives no change in the corrosion resistance of the alloy.

e) Effect of Zirconium—See Table 7

TABLE 7

| Composition | | Coupons | | Cylinders | |
|---|---|---|---|---|---|
| Change | Melt ID | mcd | mpy | mcd | mpy |
| 0% Zr (No Zirmax) | DF8581 | 2.48 | 194 | — | — |
| 0% Zr (Zirmax De-iron only) | DF 8509 | 0.7 | 56 | 0.3 | 28.5 |
| | DF 8587 | 12.10 | 944 | — | — |
| 0.5% Zr (5% Zirmax) | DF8536 DF8542 | 1.0 | 82 | 0.17 | 14 |

Generally, a lack of Zirconium resulted in very poor corrosion performance.

2. Melting Variables a) Cycling Melt Temperature before pouring Metal—See Table 8

TABLE 8

| | | Coupons | | Cylinders | |
|---|---|---|---|---|---|
| Casting Technique | Melt ID | mcd | mpy | mcd | mpy |
| Settled Plate (constant temperature) | DF8543-1 | 1.17 | 91 | — | — |
| Raised plate (Cycled temperature) | DF8501-1 | 0.4 | 32 | 0.5 | 37 |
| | DF8543-2 | 1.17 | 91 | — | — |

A constant temperature prior to casting improves settling of particles (some of which may be detrimental to corrosion performance). This test showed no benefit.

b) Argon Sparging—See Table 9

TABLE 9

| Casting | | Zirconium | Coupons | |
|---|---|---|---|---|
| Technique | Melt ID | Content | mcd | mpy |
| Unsparged Plate | DF8581-1 (25 Kg melt no Zx) | 0.00 | 2.48 | 194 |
| | DF8588-1 (60 Kg melt 5% Zx) | 0.51 | 0.98 | 77 |
| | DF8602-1 (60 Kg melt 5% Zx) | 0.51 | 0.49 | 38 |
| Sparged Plate | DF8581-2[3] (25 Kg melt 5% Zx) | 0.02 | 0.42 | 33 |
| | DF8588-2[4] (60 Kg melt 5% Zx) | 0.45 | 0.98 | 77 |
| | DF8602-2 (60 Kg melt 5% Zx) | 0.48 | 0.48 | 37 |

[4]Argon Sparged for 30 mins.

[5]Argon Sparged for 15 mins.

Argon sparging can improve the cleanliness of molten magnesium.

This data shows improved corrosion performance from some of the melts, two of which had been sparged. Note that Zr content was reduced in some cases by the sparging process.

a) Effect of Crucible Size—see Table 10

TABLE 10

| Casting | | Coupons | |
|---|---|---|---|
| Technique | Melt ID | mcd | mpy |
| 25 Kg Pot | DF8536 DF8542 | 0.9 | 71 |
| 60 Kg Pot | DF8588-1 | 1.1 | 87 |
| | DF8602-1 | 0.49 | 38 |

The effect of the melt size is not conclusive in the corrosion rate of the alloy.

3. Metal Treatments a) Effect of immersion in Hydrofluoric acid solution (HF)—See Table 11

TABLE 11

| | | Coupons | |
|---|---|---|---|
| Treatment | Melt ID | mcd | mpy |
| Not HF treated | DF8543 | 1.2 | 91 |
| HF treated | | 0.5 | 37 |

The HF treatment of the alloy does significantly improve the corrosion performance of the alloy.

b) Effect of Chromating (Chrome—Manganese)—See Table 12

TABLE 12

| | | Coupons | |
|---|---|---|---|
| Treatment | Melt ID | mcd | mpy |
| Not Chromated | DF8543 | 1.2 | 91 |
| Chromated | | 1.2 | 96 |

Chromate treatment did not improve corrosion performance.

c) Effect of HF Immersion and Subsequent Chromate Treatment—See Table 13

TABLE 13

| Treatment | Melt ID | Coupons mcd | Coupons mpy |
|---|---|---|---|
| No Treatment | DF8543 | 1.2 | 91 |
| HF dipped then Chromated | | 1.1 | 87 |

Use of Chromate conversion coatings on the alloy destroys the protection developed by immersion in HF.

These preliminary results and tentative initial conclusions were refined in the course of the further work described in the following Examples.

2. EXAMPLES

Corrosion Testing 2

Five sand-cast samples ¼" thick in the form known as "coupons" were tested. The compositions of these coupons are set out in Table 14, the remainder being magnesium and incidental impurities. ("TRE" stands for Total Rare Earths)

TABLE 14

| Melt ID | Composition (wt %) Zn | Zr | Nd | Gd | TRE | Fe |
|---|---|---|---|---|---|---|
| MT 218923 | 0.75 | 0.55 | 2.59 | 1.62 | 4.33 | 0.003 |
| MT 218926 | 0.8 | 0.6 | 2.5 | 0.4 | 3.0 | 0.003 |
| MT 218930 | 0.8 | 0.6 | 3.5 | 0.4 | 4.0 | 0.003 |
| MT 218932 | 0.8 | 0.5 | 3.5 | 1.5 | 5.2 | 0.003 |
| MT 218934 | 0.75 | 0.6 | 2.6 | 1.5 | 4.3 | 0.003 |

The coupons were radiographed, and microshrinkage was found to be present within the coupons.

All the coupons were heat treated for 8 hours at 520° C. (968° F.), hot water quenched, followed by 16 hours at 200° C. (392° F.).

The samples were grit blasted and pickled in 15% nitric acid for 90 seconds then in a fresh solution for 15 seconds. They were dried and evaluated for corrosion performance for 7 days, to ASTM B117, in a salt fog cabinet.

After 7 days the samples were rinsed in tap water to remove excess corrosion product and cleaned in hot Chromium-(IV)-Oxide (10%) and hot air dried.

The corrosion performance of the coupons is set out in Table 15.

TABLE 15

| Melt ID | Corrosion rate (mcd) | Corrosion rate (mpy) |
|---|---|---|
| MT 218923 | 0.84 | 66 |
| MT 218926 | 0.75 | 59 |
| MT 218930 | 0.81 | 63 |
| MT 218932 | 0.87 | 68 |
| MT 218934 | 0.88 | 69 |

3. EXAMPLES

Casting Testing

Casting trials were carried out to assess microshrinkage as a function of alloy chemistry.

A series of casting were produced and tested having the target compositions set out in Table 16, the remainder being magnesium and incidental impurities.

TABLE 16

| Nd | Gd | Zn | Zr |
|---|---|---|---|
| 2.6 | 1.6 | 0.75 | 0.55 |
| 2.6 | 0.4 | 0.75 | 0.55 |
| 3.5 | 0.4 | 0.75 | 0.55 |
| 3.5 | 1.6 | 0.75 | 0.55 |

All values shown are weight percent.

Melts were carried out under standard fluxless melting conditions, as used for the commercial alloy known as ZE41. (4% by weight zinc, 1.3% RE, mainly cerium, and 0.6% zirconium). This included use of a loose fitting crucible lid and $SF_6/C0_2$ protective gas.

Melt details and charges are provided in Appendix 1.

The moulds were briefly (Approximately 30 seconds—2 minutes) purged with C02/SF6 prior to pouring.

The metal stream was protected with $C0_2/SF_6$ during pouring.

For consistency, metal temperature was the same and castings were poured in the same order for each melt. Melt temperatures in the crucible and mould fill times were recorded (see Appendix 1).

One melt was repeated (MT8923), due to a sand blockage in the down sprue of one of the 925 castings.

The castings were heat-treated to the T6 condition (solution treated and aged).

The standard T6 treatment for the alloys of the present invention is:

8 Hours at 960-970° F. (515-520° C.)—quench into hot water

16 Hours at 392° F. (200° C.)—cool in air

The following components had this standard T6 treatment:

| | |
|---|---|
| Melt MT 8923 - 1 off 925 | Test bars and corrosion panels. |
| Melt MT 8926 - 1 off 925 | Test bars and corrosion panels. |
| Melt MT 8930 - 1 off 925 | Test bars and corrosion panels. |
| Melt MT 8932 - 2 off 925 | Test bars and corrosion panels. |
| Melt MT 8934 - CH47. | Test bars and corrosion panels. |

Some variations were made to the quench stage after solution treatment, to determine the effect of cooling rate on properties and residual stresses in real castings.

Details are provided below:

Melt MT 8930—1 off 925 & test bars

8 Hours at 960-970° F. (515-520° C.)—fan air cool (2 fans)

16 Hours at 392° F. (200° C.)—cool in air

Melt MT 8926—1 off 925 & test bars

Melt MT 8934—1 off 925 & test bars

8 Hours at 960-970° F. (515-520° C.)—air cool (no fans)

16 Hours at 392° F. (200° C.)—cool in air

Temperature profiles were logged and recorded by embedding thermocouples into the castings.

ASTM test bars were prepared and were tested using an Instron tensile machine.

The castings were sand blasted and subsequently acid cleaned using sulphuric acid, water rinse, acetic/nitric acid, water rinse, hydrofluoric acid and final water rinse.

It was found that the alloys of the present invention were easy to process and oxidation of the melt surface was light, with very little burning observed even when disturbing the melt during puddling operations at 1460° F.

The melt samples had the compositions set out in Table 17, the remainder being magnesium and incidental impurities.

TABLE 17

| Melt No. | Nd | Gd | Zn | Fe | Zr | TRE (wt %) |
|---|---|---|---|---|---|---|
| MT8923-F2 | 2.6 | 1.62 | 0.75 | 0.003 | 0.55 | 4.33 |
| MT8926-R | 2.54 | 0.4 | 0.82 | 0.003 | 0.65 | 3.03 |
| MT8930-R | 3.48 | 0.4 | 0.82 | 0.003 | 0.60 | 4.0 |
| MT8932-F2 | 3.6 | 1.6 | 0.77 | 0.003 | 0.53 | 5.38 |
| MT8934-F2 | 2.59 | 1.62 | 0.74 | 0.003 | 0.57 | 4.35 |

"TRE" stands for the Total Rare Earth content

The castings were tested for their mechanical properties and grain size.

a) Tensile Properties from Cast to Shape ASTM Bars Standard Heat Treatment (HWQ)—See Table 18

TABLE 18

| Melt No | 0.2% PS MPa (KSI) | UTS MPa (KSI) | Elongation | Grain Size mm (") |
|---|---|---|---|---|
| MT8923 | 183 (26.5) | 302 (43.8) | 7 | 0.015 (0.0006) |
| MT8926 | 182 (26.4) | 285 (41.3) | 6½ | 0.016 (0.0006) |
| MT8930 | 180 (26.1) | 265 (38.4) | 5 | 0.023 (0.0009) |
| MT8932 | 185 (26.8) | 277 (40.2) | 4 | 0.018 (0.0007) |
| MT8934 | 185 (26.8) | 298 (43.2) | 6 | 0.022 (0.009) |

Detailed observations recorded during the inspection of the castings are summarised as follows:

b) Surface Defects

All castings showed good visual appearance, with the exception of one misrun in melt MT8932 (High Nd/Gd content).

Dye penetrant inspection revealed some micro shrinkage (subsequently confirmed by radiography). The castings were generally very clean, with virtually no oxide related defects.

The castings can be broadly ranked into the following groups:

| | |
|---|---|
| MT 8932 (high Gd, high Nd) | Best (except for misrun) |
| MT 8923/34 (high Gd) | Similar |
| MT 8930 (high Nd) | |
| MT8926 (low Gd) | Worst |

c) Radiography

Main defect was microshrinkage.

It is difficult to provide a quantitative summary of the effect of melt chemistry on radiographic defects, due to variations between castings even from the same melts. FIG. 1 however attempts to show this by diagrammatically ranking the average ASTM E155 rating for micro shrinkage from all of the radiographic shots of each casting.

The following conclusions were reached:

A. Metal Handling

The alloys of the present invention proved to be easy for the foundry to handle.

Equipment and melting/alloying is comparable with ZE41 and much simpler than WE43.

Oxidation characteristics are similar or even better than ZE41. This is a benefit when alloying and processing the melt. Mould preparation is also simpler since gas purging can be carried out using standard practice for ZE41 or AZ91 (9% by weight aluminium, 0.8% by weight zinc and 0.2% manganese). There is no need to purge and seal the moulds with an Argon atmosphere as is required for WE43.

B. Casting Quality

Castings were largely free of oxide related defects; where present they could be removed by light fettling. This standard of surface quality is more difficult to achieve with WE43, requiring much more attention to mould preparation and potential for rework.

The main defect present was microshrinkage. The present alloys are considered to be more prone to microshrinkage than ZE41.

Whilst changes in the rigging system (use of chills and feeders) are the most effective way to resolve microshrinkage, modifications to the alloy chemistry can help. This latter point was addressed in this casting trial.

A true assessment can only be achieved by the production of many castings, however from this work the following general trends were observed:

Microshrinkage is reduced when Nd and/or Gd content is increased

Higher Nd shows a small increase in the tendency for segregation to develop

High alloy content (particularly of Nd) appears to make the molten metal slow to fill the mould. This can lead to misrun defects.

C. Mechanical Properties

Tensile properties are good.

Yield strength is very consistent between all melts tested indicating a wide tolerance to melt chemistry.

High Nd levels (3.5%) had the effect of reducing ductility and fracture strength. This would be expected to be as a consequence of greater amounts of insoluble Nd rich eutectic.

High Gd levels (1.6%) did not reduce fracture strength or ductility. If any trend is present, an improvement in fracture strength is associated with higher Gd content.

APPENDIX 1

MELT DETAILS MT8923, MT8926, MT8930, MT8932, MT8934
Input Material Analysis

| | Nd | Gd | Zn | Weight % |
|---|---|---|---|---|
| Nd Hardener | 26½ | — | — | |
| Gd Hardener (DF8631) | — | 21 | — | |
| Sample Ingot | | | | |
| SF3739 | 2.64 | 0.42 | 0.87 | |
| SF3740 | 2.68 | 1.29 | 0.86 | |
| Scrap Material | | | | |
| MT8145 | 2.8 | 0.27 | | |

For all of the melts their zirconium contents were full, ie 0.55% by weight.

| Melt MT8923 | | | | |
|---|---|---|---|---|
| | Nd | Gd | Zn | Weight % |
| Target Composition | 2.6 | 1.7 | 0.8 | |
| Charge | | | | |
| 279 lbs | Sample Ingot (SF3740) | | | |
| 8 lb 4 oz | Gd Hardener (DF8631 21% Gd) | | | |
| 2 lb 6 oz | Nd Hardener (26.5% Nd) | | | |
| 18 lbs | Zirmax | | | |

Procedure

Clean 300 lb crucible used 09.00—Ingot began melting 10.15—Analysis sample taken 10.30—1400° F.—Hardeners added 10.45—1450° F.—Mechanical stirrer used for 3 minutes 10.50—1465° F.—Clean off melt surface 10.52—Analysis sample taken 10.58—1496° F.—Die bar taken and start of settle period 11.30—1490° F.—Lift crucible to pour

| Pouring | | | |
|---|---|---|---|
| Casting | Temperature (° F.) | Fill Time (S) | Comments |
| ASTM Bars | 1460 | — | — |
| 925 # 1 | 1448 | 90+ | No Fill - Downsprue Blocked |
| Corrosion Plate | 1428 | 25 | |
| 925 # 2 | 1422 | 51 | |
| Corrosion Plate | 1415 | 21 | |
| Weld Plate | 1411 | — | |

| Melt MT8926 | | | | |
|---|---|---|---|---|
| | Nd | Gd | Zn | Weight % |
| Target Composition | 2.56 | 0.4 | 0.8 | |
| Charge | | | | |
| 269 lbs | Sample Ingot (SF3739) | | | |
| 0 lbs | Gd Hardener (DF8631) | | | |
| 2.1 lbs | Nd Hardener (26.5% Nd) | | | |
| 17.4 lbs | Zirmax | | | |

Procedure

Clean 300 lb crucible used 09.00—Start melt 09.00—Analysis sample taken 10.30—1400° F.—Addition made 10.40—1440° F.—Melt surface cleaned 10.45—1458° F.—Melt stirred as MT8923

10.50—1457° F.

10.55—1468° F.—Analysis sample and die bar taken 11.12—1494° F.

11.28—1487° F.—Lift crucible to pour

NB—Only ½ ingot left after pouring castings—need more metal

| Pouring | | | |
|---|---|---|---|
| Casting | Temperature (° F.) | Fill Time (S) | Comments |
| ASTM Bars | 1460 | — | |
| 925 # 3 | 1448 | 45 | |
| Corrosion Plate | 1438 | 16 | |
| 925 # 4 | 1433 | 41 | |
| Corrosion Plate | 1426 | 20 | |
| Weld Plate | 1420 | 19 | |

Melt MT8930

| Melt MT8930 | | | | |
|---|---|---|---|---|
| | Nd | Gd | Zn | Weight % |
| Target Composition | 3.5 | 0.4 | 0.8 | |
| Charge | | | | |
| 273 lbs | Sample Ingot (SF3739) | | | |
| 0.12 lbs | Gd Hardener (DF8631) | | | |
| 14 lbs | Nd Hardener | | | |
| 18 lbs | Zirmax | | | |

Procedure

Clean 300 lb crucible used 09.00—Melt started 10.10—Part melted 11.00—1400° F.—Alloyed hardeners 11.20—1465° F.—Melt stirred as MT8923

11.30—Die bar and analysis sample taken 11.40—1503° F.

12.05—1489° F.—Lift crucible to pour

| Pouring | | | |
|---|---|---|---|
| Casting | Temperature (° F.) | Fill Time (S) | Comments |
| ASTM Bars | 1460 | — | |
| 925 # 6 | 1447 | 46 | |
| Corrosion Plate | 1437 | 16 | |
| 925 # 5 | 1432 | 51 | |
| Corrosion Plate | 1424 | 18 | |
| Weld Plate | 1419 | — | |

| Melt MT8932 | | | | |
|---|---|---|---|---|
| | Nd | Gd | Zn | Weight % |
| Target Composition | 3.5 | 1.6 | 0.8 | |

| Charge | |
|---|---|
| 120 lbs | Scrap (ex MT8923) |
| 160 lbs | Sample Ingot (SF3740) |
| 6.5 lbs | Gd Hardener (DF8631) |
| 17.1 lbs | Nd Hardener |
| 15 lbs | Zirmax |

Procedure

Clean 300 lb crucible used 06.30—Melt started 08.00—1370° F.—Holding 09.00—1375° F.—Alloy hardeners 09.25—1451° F.—Puddle as MT8923

09.33—1465° F.—Cast analysis sample 09.45—1495° F.—Settling. Burner input 10% flame 09.50—1489° F.—Settling. Burner input 20% flame *

10.00—1490° F.—Cast final analysis block—Lift crucible

* Settle not quite as good as some melts—needed to increase burner near end of melt

| Pouring | | | |
|---|---|---|---|
| Casting | Temperature (° F.) | Fill Time (S) | Comments |
| ASTM Bars | 1460 | — | — |
| 925 # 9 | 1452 | 60 | RH riser (D Sprue furthest away) did not fill all the way |
| Corrosion Plate | 1438 | 19 | |
| 925 # 7 | 1433 | 48 | |
| Corrosion Plate | 1424 | 16 | |
| Weld Plate | 1420 | 16 | |

| Melt MT8934 | | | | |
|---|---|---|---|---|
| | Nd | Gd | Zn | Weight % |
| Target Composition | 2.6 | 1.7 | 0.8 | |

| Charge | |
|---|---|
| 170 lbs | Scrap (ex MT8145) |
| 113 lbs | Sample Ingot (SF3740) |
| 18.3 lbs | Gd Hardener (DF8631) |
| 2.9 lbs | Nd Hardener |
| 16.3 lbs | Zirmax |

Procedure 10.30—Melt charged into well cleaned crucible from previous melt 11.30—Melt molten and holding 12.05—1400° F.—Analysis block taken —1402° F.—Hardeners alloyed 12.40—1430° F.

12.50—1449° F.—1461° F.—Melt puddle as MT8923

13.00—1461° F.—Analysis sample taken 13.05—1498° F.—Start settle 13.15—1506° F.

13.30—1492° F.—Burner input 17%

13.32—1491° F.—Lift crucible to pour

| Pouring | | | |
|---|---|---|---|
| Casting | Temperature (° F.) | Fill Time (S) | Comments |
| CH47 | 1450 | 35 | (ZE41 is 31S) |
| 925 # 8 | 1442 | 42 | |
| ASTM Bars | — | — | |
| Corrosion Plate | — | — | Crucible virtually empty. Metal quality likely to be poor in last moulds |

4. EXAMPLES

Ageing Trials

The hardness of samples of the preferred alloy of the present invention were tested and the results are set out in FIGS. 2 to 4 as a function of ageing time at 150, 200 & 300° C. respectively.

There is a general trend that the addition of gadolinium shows an improvement in the hardness of the alloy.

In FIG. 2 the alloy with the highest gadolinium content has consistently better hardness. The hardness improvement over that after solution treating is similar for the alloys. Also the scope of the testing was not long enough for peak hardness to be achieved as hardening is shown to occur at a relatively slow rate at 150° C. As peak age has not been reached, the effect of gadolinium on over-ageing at this temperature could not be investigated.

FIG. 3 still shows an improvement in hardness by gadolinium addition, as even when errors are considered the 1.5% gadolinium alloy still has superior hardness throughout ageing and shows an improvement in peak hardness of about 5 MPa. The gadolinium addition may also reduce the ageing time needed to achieve peak hardness and improve the over-age properties. After 200 hours ageing at 200° C. the hardness of the gadolinium-free alloy shows significant reduction, while the alloy with 1.5% gadolinium still shows hardness similar to the peak hardness of the gadolinium-free alloy.

The ageing curves at 300° C. show very rapid hardening by all the alloys, reaching peak hardness within 20 minutes of ageing. The trend of improved hardness with gadolinium is also shown at 300° C. and the peak strength of the 1.5% gadolinium alloy is significantly higher (~10 $Kgmm^{-2}$ [MPa]) than that of the alloy with no gadolinium. A dramatic drop in hardness with over-ageing follows the rapid hardening to peak age. The loss of hardness is similar for all alloys from their peak age hardness. The gadolinium-containing alloys retain their superior hardness even during significant over-ageing.

FIG. 5 and FIG. 7 are micrographs showing the area through which line-scans were taken on the 'as cast' and peak aged (T6) specimen respectively. The probe operated at 15 kV and 40 nA. The two micrographs show similar grain sizes in the two structures.

The second phase in FIG. 5 has a lamellar eutectic structure. FIG. 7 shows that after T6 heat treatment there is still significant retained second phase present. This retained second phase is no longer lamellar but has a single phase with a nodular structure.

Within the grains of the as-cast structure a large amount of coarse, undissolved particles are also seen. These are no longer present in the heat-treated samples, which show a more homogeneous grain structure.

The superimposed lines on the micrographs show the placement of the 80 μm line scans.

FIG. 6 and FIG. 8 are plots of the data produced by the EPMA line scans for magnesium, neodymium and gadolinium. They show qualitatively the distribution of each element in the microstructure along the line scan.

The y-axis of each graph represents the number of counts relative to the concentration of the element at that point along the scan. The values used are raw data points from the characteristic X-rays given from each element The x-axis shows the displacement along the scan, in microns.

No standards were used to calibrate the counts to give actual concentrations for the elements so the data can only give qualitative information regarding the distribution of each element. The relative concentration of each element at a point cannot be commented on.

FIG. 6 shows that, as in the 'as-cast' structure, the gadolinium and neodymium are both concentrated at the grain boundaries as expected from the micrographs, as the main peaks for both lie at approximately 7, 40 & 80 microns along the scan. It also shows that the rare earth levels are not constant within the grains as their lines are not smooth in between peaks. This suggests that the particle seen in the micrograph (FIG. 5) within the grains may indeed contain gadolinium and neodymium.

There is also a dip in the line for magnesium at about 20 microns; this correlates to a feature in the micrograph. This dip is not associated with an increase in neodymium or gadolinium, and therefore the feature must be associated with some other element, possibly zinc, zirconium or simply an impurity.

FIG. 8 shows the distribution of the elements in the structure of the alloy after solution treatment and peak ageing. The peaks in the rare earths are still in similar positions and still match the areas of second phase at grain boundaries (~5, 45 & 75 microns). The areas between the peaks have however become smoother than in FIG. 6, which correlates to the lack of intergranular precipitates seen in FIG. 7. The structure has been homogenised by the heat treatment and the precipitates present within the grains in the as-cast have dissolved into the primary magnesium phase grains.

The amount of second phase retained after heat treatment shows that the time at solution treatment temperature may not be sufficient to dissolve all the second phase and a longer solution treatment temperature may be required. However it may also be possible that composition of the alloy is such that it is in a two-phase region of its phase diagram. This is not expected from the phase diagrams of Mg—Gd and Mg—Nd [NAYEB-HASHEMI 1988] binary systems, however as this system is not a binary system these diagrams cannot be used to accurately judge the position of the solidus line for the alloy. Therefore the alloy may have alloying additions in it that surpass its solid solubility, even at the solution treatment temperature. This would result in retained second phase regardless of the length of solution treatment.

5. EXAMPLES

Effect of Zinc, Gadolinium and Heat Treatment on the Corrosion Behaviour of the Alloys The effect of varying composition and heat treatment regimes on the corrosion behaviour of the alloys of the present invention was investigated in detail. For comparison equivalent alloys without zinc were also tested.

For this series of tests samples of alloys in the form of sand-cast plates of dimension 200×200×25 mm (8×8×1") were cast from alloy melts in which the gadolinium and zinc levels were varied (see Table 19). The neodymium and zirconium levels were kept within a fixed range as follows:

Nd: 2.55-2.95% by weight

Zr: 0.4-0.6% by weight

Samples from the edge and from the centre of each plate were subjected to one of the following heat treatment regimes:

(i) Solution treatment followed by hot water quench (T4 HWA)

(ii) Solution treatment followed by hot water quench and age (T6 HWA)

(iii) Solution treatment followed by air cool* and age T6 AC)

(iv) Solution treatment followed by fan cool and age (T6 FC)

* The rate of cooling for each sample during an air cool was 2° C./s.

All solution treatments were conducted at 520° C. (968 F) for 8 hrs and ageing was conducted at 200° C. (392 F) for 16 hrs.

The samples were alumina-blasted using clean shot to remove surface impurities prior to acid pickling. Each sample was pickled (cleaned) in 15% $HN0_3$ solution for 45 s prior to corrosion testing. Approximately 0.15-0.3 m (0.006-0.012") thickness of metal was removed from each surface during this process. The freshly pickled samples were subjected to a salt-fog spray test (ASTMB117) for corrosion behaviour evaluation. The cast surfaces of the samples were exposed to the salt fog.

The corrosion test results are shown in FIGS. 9 to 11.

In the alloy samples of the invention which contained zinc, corrosion was observed to occur predominantly in regions of precipitates whereas in equivalent very low zinc and zinc-free alloys corrosion occurred preferentially at grain boundaries and occasionally at some precipitates. The zinc content of the samples tested significantly affected corrosion behaviour; corrosion rates increased with increasing zinc levels. Corrosion rates also increased when the zinc content was reduced to near impurity levels. Gadolinium contents also affected corrosion behaviour, but to a lesser extent that zinc content. Generally in the T6 (HWQ) condition, alloys containing <0.65-1.55% gadolinium gave corrosion rates <100 mpy providing that the zinc content did not exceed 0.58%, whereas, alloys containing 1.55-1.88% gadolinium could generally contain up to 0.5% zinc before corrosion rate exceeded 100 mpy. In general, it was observed that the alloys that had been hot water quenched after solution treatment achieved lower corrosion rates than alloys that had been air- or fan-cooled. This might possibly be due to variations in distribution of precipitate between fast and slow cooled samples.

6. EXAMPLES

Gadolinium Limitations

Some experiments were carried out to investigate the effect of varying the amount of gadolinium as compared with replacing it with another commonly used RE, namely cerium. The results are as follows:

| Analysis | | | | | |
|---|---|---|---|---|---|
| Sample | Nd | Ce | Gd | Zn | Zr (wt %) |
| DF8794 | 3.1 | 1.2 | — | 0.52 | 0.51 |
| DF8798 | 2.8 | — | 1.36 | 0.42 | 0.52 |
| DF8793 | 2.4 | — | 6 | 0.43 | 0.43 |
| MT8923 | 2.6 | — | 1.62 | 0.75 | 0.55 |

| Tensile Properties | | | |
|---|---|---|---|
| Sample | 0.2% YS (MPa) | UTS (MPa) | Elongation (%) |
| DF8794 | 165 | 195 | 1 |
| DF8798 | 170 | 277 | 5 |
| DF8793 | 198 | 304 | 2 |
| MT8923 | 183 | 302 | 7 |

All alloy samples were solution treated and aged prior to testing.

Comparison of samples DF8794 and DF8798 shows that when the commonly used RE cerium is used in place of the HRE preferred in this invention, namely gadolinium, tensile strength and ductility are dramatically reduced.

A comparison of DF8793 and MT8923 shows that increasing the gadolinium content to a very high level does not offer a significant improvement in properties. In addition, the cost and increasing density (the density of gadolinium is 7.89 compared with 1.74 for magnesium) militates against the use of a gadolinium content greater than 7% by weight.

TABLE 19

| Description | Melt no. | Composition | | | |
|---|---|---|---|---|---|
| | | % Zn | % Gd | % Nd | % Zr |
| "Standard"-High Zn/Mid Gd | DF8737 | 0.78 | 1.376 | 2.74 | 0.47 |
| High Zn/High Gd | DF8726 | 0.84 | 1.878 | 2.79 | 0.49 |
| High Zn/Mid Gd | DF8779 | 0.62 | 0.964 | 2.65 | 0.58 |
| High Zn/Low Gd | DF8739 | 0.67 | 0.425 | 2.89 | 0.50 |
| Mid Zn/High Gd | DF8784 | 0.54 | 1.956 | 2.79 | 0.45 |
| Mid Zn/High Gd | DF8774 | 0.43 | 1.689 | 2.68 | 0.46 |
| Mid Zn/High Gd | DF8777 | 0.34 | 1.709 | 2.64 | 0.53 |
| Mid Zn/Mid Gd | DF8783 | 0.53 | 1.527 | 2.84 | 0.44 |
| Mid Zn/Mid Gd | DF8782 | 0.50 | 1.034 | 2.73 | 0.52 |
| Mid Zn/Mid Gd | DF8773 | 0.42 | 1.219 | 2.55 | 0.55 |
| Mid Zn/Mid Gd | DF8778 | 0.42 | 0.958 | 2.63 | 0.52 |
| Mid Zn/Mid Gd | DF8752 | 0.40 | 1.311 | 2.81 | 0.40 |
| Mid Zn/Mid Gd | DF8776 | 0.33 | 1.142 | 2.62 | 0.46 |
| Low Zn/High Gd | DF8754 | 0.16 | 1.980 | 2.60 | 0.44 |
| Low Zn/Mid Gd | DF8738 | 0.19 | 1.351 | 2.68 | 0.43 |
| Low Zn/Low Gd | DF8753 | 0.17 | 0.382 | 2.73 | 0.45 |
| No Zn/Mid Gd | DF8772 | 0.02 | 1.376 | 2.94 | 0.47 |
| No Zn/Low Gd | DF8770 | 0.01 | 0.448 | 2.70 | 0.43 |

High Mid Low

7. EXAMPLES

Wrought Alloy—Mechanical Properties

Samples were taken from a 19 mm (0.75") diameter bar extruded from a 76 mm (3") diameter water-cooled billet of the following composition in weight percent, the remainder being magnesium and incidental impurities:

| | |
|---|---|
| % Zn | 0.81 |
| % Nd | 2.94 |
| % Gd | 0.29 |
| % Zr | 0.42 |
| % TRE | 3.36 |

As with other test alloys where there is a difference between the TRE (Total Rare Earth content) and the total of the neodymium and HRE—here gadolinium—this is due to the presence of other associated rare earths such as cerium.

The mechanical properties of the tested alloy in its T6 heat treatment condition are shown in Table 20.

TABLE 20

| | | Tensile Properties | | | |
|---|---|---|---|---|---|
| Test Temperature (° C.) | Heat Treatment | 0.2% Proof Stress (MPa) | Tensile Stress (MPa) | Elongation (%) | Vickers Hardness |
| 20 | T6 | 134 | 278 | 22 | 75 |
| 250 | T6 | 117 | 173 | 30.0 | — |

The invention claimed is:

1. A castable magnesium based alloy comprising (in % by weight):

at least 85% of magnesium;
2.0 to 3.5% of neodymium;
1.0 to 1.7% of gadolinium;
0.2 to 1.3% of zinc;
0.2 to 0.7% of zirconium;
up to 1% of calcium;
up to 0.4% of hafnium and/or titanium;
up to 0.5% of manganese;
no more than 0.001% of strontium;
no more than 0.05% of silver;
no more than 0.1% of aluminum;
no more than 0.01% of iron; and
excluding yttrium added to the alloy;
with any remainder being incidental impurities.

2. An alloy as claimed in claim 1 wherein the alloy contains 2.5 to 3.5% by weight of neodymium.

3. An alloy as claimed in claim 1 wherein the alloy contains about 2.8% by weight of neodymium.

4. An alloy as claimed in claim 1 wherein the alloy contains about 1.5% by weight of gadolinium.

5. An alloy as claimed in claim 1 wherein the alloy contains zinc in an amount of 0.2 to 0.6% by weight.

6. An alloy as claimed in claim 1 wherein the alloy contains zinc in an amount of about 0.4% by weight.

7. An alloy as claimed in claim 1 wherein the alloy contains zirconium in an amount of 0.4 to 0.6% by weight.

8. An alloy as claimed in claim 1 wherein the alloy contains zirconium in an amount of about 0.55% by weight.

9. An alloy as claimed in claim 1 wherein the alloy contains less than 0.005% by weight of iron.

10. An alloy as claimed in claim 1 wherein the amount of said incidental impurities of said alloy is not greater than 0.3% by weight.

11. A cast or wrought product when formed from an alloy as claimed in claim 1.

12. A product formed from the alloy of claim 1 wherein said product has an elongation of greater than 5%.

13. A product formed from the alloy of claim 1 wherein said product has a corrosion resistance at a rate less than 100 mpy according to ASTM B117.

14. A method of producing a product formed from the magnesium based alloy of claim 1 including the steps of sand casting, permanent mold casting or high pressure die casting said magnesium based alloy.

15. A method as claimed in claim 14 including the step of age hardening the cast alloy at a temperature of 150° C. for at least 10 hours.

16. A method as claimed in claim 14 including the step of age hardening the cast alloy at a temperature of 200° C. for at least 1 hour.

17. A method as claimed in claim 14 including the step of age hardening the cast alloy at a temperature of 300° C.

18. A method as claimed in claim 14 including the steps of solution heat treating and then quenching the cast alloy.

19. A method as claimed in claim 18 wherein the quenching step is effected by hot water quenchant.

20. A method as claimed in claim 14 wherein said product is in its T6 temper.

21. A cast product produced by a method as claimed in claim 14.

* * * * *

UNITED STATES PATENT AND TRADEMARK OFFICE

CERTIFICATE OF CORRECTION

PATENT NO. : 7,935,304 B2
APPLICATION NO. : 10/545621
DATED : May 3, 2011
INVENTOR(S) : Paul Lyon et al.

It is certified that error appears in the above-identified patent and that said Letters Patent is hereby corrected as shown below:

In Table 19, line 1, please delete "0.78" in the column under % Zn and insert therefor --0.73--.

In Table 19, line 14, please delete "1.980" in the column under % Gd and insert therefor --1.930--.

Signed and Sealed this
Nineteenth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,935,304 B2
APPLICATION NO. : 10/545621
DATED : May 3, 2011
INVENTOR(S) : Paul Lyon et al.

It is certified that error appears in the above-identified patent and that said Letters Patent is hereby corrected as shown below:

On the title page, item [73], please delete "Magnesium Electron Ltd." and insert therefor --Magnesium Elektron Ltd.--.

Signed and Sealed this
Sixth Day of March, 2012

David J. Kappos

David J. Kappos
*Director of the United States Patent and Trademark Office*